US006673028B1

(12) United States Patent
Argenta et al.

(10) Patent No.: US 6,673,028 B1
(45) Date of Patent: Jan. 6, 2004

(54) PASSIVE JOINT MOVEMENT DEVICE AND METHOD FOR USING THE SAME

(75) Inventors: Louis C. Argenta, Winston-Salem, NC (US); Michael J. Morykwas, Pfafftown, NC (US)

(73) Assignee: Wake Forest University Health Sciences, Winston-Salem, NC (US)

( * ) Notice: Subject to any disclaimer, the term of this patent is extended or adjusted under 35 U.S.C. 154(b) by 0 days.

(21) Appl. No.: 09/269,341

(22) PCT Filed: Sep. 25, 1997

(86) PCT No.: PCT/US97/17252

§ 371 (c)(1),
(2), (4) Date: Sep. 27, 1999

(87) PCT Pub. No.: WO98/13005

PCT Pub. Date: Apr. 2, 1998

Related U.S. Application Data

(60) Provisional application No. 60/026,663, filed on Sep. 26, 1996.

(51) Int. Cl.[7] ..... A61H 1/00

(52) U.S. Cl. ..... 601/40; 601/23; 482/49

(58) Field of Search ..... 601/23, 40, 6, 601/9–11; 482/44, 49; 128/898; 602/13

(56) References Cited

U.S. PATENT DOCUMENTS

| | | | | |
|---|---|---|---|---|
| 1,332,933 A | * | 3/1920 | Sylvester | |
| 2,620,493 A | * | 12/1952 | Brelsford | 5/348 |
| 3,745,998 A | * | 7/1973 | Rose | 602/6 |
| RE31,898 E | * | 5/1985 | Suter | 52/2.18 |
| 4,552,135 A | * | 11/1985 | Racz et al. | 128/78 |
| 4,628,945 A | * | 12/1986 | Johnson, Jr. | 602/27 |
| 4,671,258 A | | 6/1987 | Barthlome | |
| 4,867,140 A | | 9/1989 | Hovis et al. | |
| 4,907,574 A | | 3/1990 | Hollerbach | |
| 5,005,824 A | * | 4/1991 | Eichel | 272/67 |
| 5,060,661 A | * | 10/1991 | Howard | 128/845 |
| 5,259,369 A | | 11/1993 | Matsumura et al. | |
| 5,303,435 A | * | 4/1994 | Haar et al. | 5/450 |
| 5,399,152 A | | 3/1995 | Habermeyer et al. | |
| 5,409,447 A | * | 4/1995 | Wedge, Jr. | 601/40 |
| 5,577,998 A | | 11/1996 | Johnson, Jr. et al. | |
| 5,634,224 A | * | 6/1997 | Gates | 5/709 |
| 6,151,735 A | * | 11/2000 | Koby | 5/644 |
| 6,159,172 A | * | 12/2000 | Gray et al. | 601/149 |

FOREIGN PATENT DOCUMENTS

GB 2195255 A 2 * 4/1988

* cited by examiner

*Primary Examiner*—Justine R. Yu
(74) *Attorney, Agent, or Firm*—Donald R. Piper, Jr.; Dann, Dorfman, Herrell & Skillman, PC

(57) ABSTRACT

A passive movement deivce for exercising a patient's joint is provided. The device includes a resilient foam section and a casing enclosing the foam section within a sealed chamber. The patient's joint is held in position relative to the sealed chamber by a suitable retainer. A vacuum pump is operatively connected with the sealed chamber to selectively provide application and non-application of a reduced pressure, i.e. below atmospheric, to the sealed chamber. The application of the reduced pressure causes the foam section to collapse thereby exerting a force on the joint which causes the joint to move or bend from a predetermined position. The non-application of the reduced pressure to the sealed chamber causes the foam section to expand thereby exerting a force on the joint which causes the joint to move or bend toward the predetermined position.

27 Claims, 6 Drawing Sheets

PASSIVE JOINT MOVEMENT DEVICE AND METHOD FOR USING THE SAME

This application is a national stage application of international application PCT/US97/17252, filed on Sep. 25, 1997, and claims the benefit of the filing date of U.S. Provisional Application No. 60/026,663, filed Sep. 26, 1996.

FIELD OF THE INVENTION

The present invention relates to a device and a method for moving a joint and, more specifically, to a device and method for passively exercising a patient's joint in effort to return the joint to a more natural range of motion.

BACKGROUND OF THE INVENTION

Patients who have suffered damage to tendons, soft tissue, or bone near a joint, either from trauma or disease, are frequently advised to adhere to an exercise regime to prevent the loss of mobility in the joint. Often, the exercise regime requires a physical therapist or a complex and expensive machine, such as a continuous passive motion (CPM) machine to repeatedly move the joint. With many patients, however, the inconvenience of attending to such treatments severely affects the time that such therapy is administered.

Another problem to effective treatment is that many exercise regimes require motivation, diligence, and perseverance on the part of the patient. For example, inactivity during the night causes many patients with arthritis or other types of joint stiffness to experience a decrease in the range of motion of an affected joint. As a result, such patients are often advised to spend a certain amount of time each morning manually moving and bending the affected joint. Although the prescribed exercise program is intended to restore the joint to its natural range of motion, patients often fail to perform the necessary exercises due to pain, frustration, or inconvenience. This is a significant drawback with a manual exercise treatment that requires a high level of patient compliance in order to be effective.

Accordingly, different types of passive movement devices have been employed. Such devices typically exercise a joint by flexing and/or extending the joint using inflatable members, such as pouches, bladders, or sacs, which are attached to the joint. Movement is effected by cyclically inflating and deflating the inflatable members with gas, fluid, or heated fluid. However, such positive pressure devices are not always practical and are not always effective in applying a suitable force during deflation of the bladder to properly exercise the joint. Additionally, there is an attendant risk that the inflatable member will burst during use.

In other conventional devices, the joint is alternately flexed and extended by attaching inflatable members to both the flexion and extension sides of the joint. The joint is then systematically flexed and extended by cyclically inflating one of the inflatable members and deflating the other inflatable member in a synchronous manner. however, such systems require precise timing of inflation and deflation of the inflatable members to apply suitable pressure for effective treatment.

In other conventional devices, the joint is alternately flexed and extended by attaching inflatable members to both the flexion and extension sides of the joint. The joint is then systematically flexed and extended by cyclicly inflating one of the inflatable members and deflating the other inflatable member in a synchronous manner. However, such systems require precise timing of inflation and deflation of the inflatable members to apply suitable pressure for effective treatment.

One method of avoiding the difficulties associated with the use of multiple inflatable members has been to use a spring steel element to bias the joint into the non-extended position, in conjunction with the use of an inflatable pouch positioned on the extension or outer side of the joint to bias the joint into the extended position. In operation, the joint is extended by inflating the pouch. The joint is then flexed by deflating the pouch and allowing the spring steel element to return the joint to the flexed position. However, with certain patients, the spring steel biasing element may apply excessive forces at points of connection or attachment to the patient's joint. In addition, it is difficult to control or regulate the application of the force to achieve more uniform pressure to tissues surrounding the joint.

In light of the foregoing, it would be desirable to provide a device for passively exercising a joint wherein the device is biased to the neutral or extended position in such a manner that the biasing force is exerted uniformly to the underlying tissue without the use of positive pressure devices such as inflatable bladders.

SUMMARY OF THE INVENTION

The present invention relates to a passive movement device for moving or exercising a selected joint or joints of a patient. The device is secured into proper position at or about a selected joint and is then operated to move or exercise the patient's joint in a controlled manner. The passive movement device comprises a resilient, open-cell foam section and a flexible cover or casing that functions to enclose the foam section to form a sealed chamber. Joint positioning means is used to maintain the joint to be treated at a desired position in relation to the device. For example, hand and finger slots may be provided in the foam section to effect proper retention and positioning of a patient's hand. Alternatively, a glove may be fixedly or removably attachable to the sealed chamber to properly hold the patient's hand in position. In applications in which another joint such as a patient's elbow is being treated, a sleeve may be used to secure the sealed chamber at the elbow joint.

A pump in the form of a vacuum pump is operatively connected with the sealed chamber to supply a reduced pressure, i.e. below atmospheric pressure, to the sealed chamber. The application of reduced pressure to the sealed chamber, for example, during the "on" cycle of the pump, collapses the pores in the foam section thereby collapsing or contracting the sealed chamber against the resiliency of the foam section in a controlled manner dependant on the amount and timing of the suction. Collapsing the sealed chamber exerts a force on the joint causing the joint to bend from a first or neutral position, i.e. a relaxed position between full extension and full bending. Since the pores are distributed throughout the foam section, the force is exerted generally uniformly to the underlying tissue. The suction may then be removed, for example during the "off" cycle of the pump, causing the foam section to expand back toward its original position, due to the resiliency of the foam section, thereby causing the joint to bend back toward the first or neutral position.

The foam section may comprise any of a number of commercially available materials, such as a sponge, having an open-cell structure. The foam section provides a resilient member for returning the sealed chamber to its uncollapsed position when the suction supplied by the vacuum is sufficiently reduced or removed. The porosity and resiliency of the foam section can be chosen for particular uses. For example, a foam section having smaller pores or cells provides a greater biasing force and, therefore, may be preferred when treating a particularly stiff joint. Conversely, when a weaker force will suffice, a more compressible foam section may be preferred. In addition, the foam section may comprise two or more adjoining sections having different degrees of stiffness.

The foam section can be provided in a variety of sizes and shapes to fit the individualized needs of a particular patient. The foam section may be shaped to comfortably fit along the flexion or inner side of the joint when the joint is in either the neutral or the extended position. Alternatively, the foam section can be shaped to conform to the extension or outer side of the joint when the joint is in either the neutral or the flexed position.

The cover or casing for enclosing and sealing the foam section can be formed of a plastic laminate or sheet which is wrapped or folded around the foam section to provide the sealed chamber. Additionally, the cover can be molded around the foam section to form the sealed chamber. The cover can be manufactured of any of a variety of materials, such as polyruethane films, provided that the material is substantially gas-impermeable and sufficiently flexible to contract and stretch during the application and non-application of the reduced pressure to the sealed chamber. Alternatively, the cover can be formed by coating the outer surface of the foam section with a substance which is sufficiently flexible or substantially gas-impermeable, or by otherwise sealing the pores on the outer surface of the foam section, such as by heat sealing.

The joint positioning means can include grooves or holes which are appropriately shaped within the foam section to accommodate the selected joint and hold the device in position on the joint. For example, the positioning means may include finger or hand holes in the foam section. Alternatively, the positioning means can comprise a glove or a mitten, or selected portions thereof, which is attachable with the sealed chamber to maintain the sealed chamber in the desired position relative to the joints to be treated. The glove or mitten may be made from a porous material, such as cotton, for the patient's comfort. Securing means such as straps or belts can be provided to maintain the device in the desired position relative to the patient's joint.

Suction means is provided in the form of a vacuum pump connected with the cover of the sealed chamber by a fluid transmission tube. The tube is in fluid communication with the sealed chamber to enable the reduced pressure to be supplied to the sealed chamber. One end of the tube is positioned within the sealed chamber and may be embedded within the foam section. The other end of the tube is external of the sealed chamber and connects with the vacuum pump.

One or more struts may optionally be utilized for reinforcing the foam section at selected positions relative to the patient's joint. The strut may be in the form of a rigid or semi-rigid rod of suitable material, such as wood or plastic, which is embedded in the foam section. The strut may be disposed within the foam section so as to be positioned on the inner side of the joint and to extend in a transverse direction relative to the joint. The strut functions to restrict the contraction of the foam section in a direction parallel to the strut, thereby reducing forces on the joint transverse to the direction in which the joint bends. As such, the strut facilitates the proper bending of the joint around the strut.

Particularly stiff joints may require a greater force to return the joint back to the neutral position than the force that is supplied by the foam section resiliently returning to its original shape. In such cases, sealed chambers incorporating separate foam sections may be positioned on both sides of the joint. Accordingly, a first foam section enclosed in a first sealed chamber is positioned at the outer or extension side of the joint and a second foam section enclosed in a second sealed chamber is positioned at the inner or flexion side of the joint. When the joint is in a flexed or neutral position, suction is applied to the first sealed chamber and is removed from the second sealed chamber so that the first foam section collapses and the second foam section expands causing the joint to extend. Alternatively, suction is applied to the second sealed chamber and is removed from the first sealed chamber so that the second foam section collapses and the first foam section expands causing the joint to flex. The use of the two sealed chambers enables the joint to more easily flex and extend from the neutral position.

The present invention also relates to a method for passively exercising a patient's joint. A device, comprising a foam section and a casing enclosing the foam section within a sealed chamber, is positioned at the desired location relative to the joint to be exercised. The device may, for example, be positioned at the flexion or inner side of the joint.

A reduced pressure is then applied to the sealed chamber at a controlled rate and at a controlled magnitude of vacuum. The application of reduced pressure to the sealed chamber causes the pores of the foam section to collapse at a predetermined rate, thereby applying a predetermined force to the joint to produce a predetermined range of motion in the joint. When the foam section is positioned on the inner side of the joint, the application of suction to the sealed chamber causes the joint to bend from its neutral or its extended position.

After the foam section has been collapsed and the joint has been moved, the reduced pressure within the sealed chamber is released. As the pressure returns to atmospheric pressure, the foam section returns to its original shape and size. As the foam section expands, a force is exerted on the joint causing the joint to return to its neutral or its extended position.

The controlled rate of collapse and the controlled magnitude of the applied pressure allow the joint to be moved in a manner which is best suited for each individual patient. For example, joints at the start of treatment are apt to be stiffer and require a greater force to move the joint, thus a higher vacuum may be used initially to evacuate the chamber. Also at the start of treatment, the patient may experience more pain with joint movement and, hence, a slower rate of movement may be better to minimize the amount of associated pain. Accordingly, the vacuum may be applied at higher magnitudes of pressure but at less frequent intervals at the start of treatment.

BRIEF DESCRIPTION OF THE DRAWINGS

The foregoing summary, as well as the following detailed description of the preferred embodiments of the present invention, will be better understood when read in conjunction with the accompanying drawings, in which.

DETAILED DESCRIPTION OF THE PREFERRED EMBODIMENTS

Figure 1:
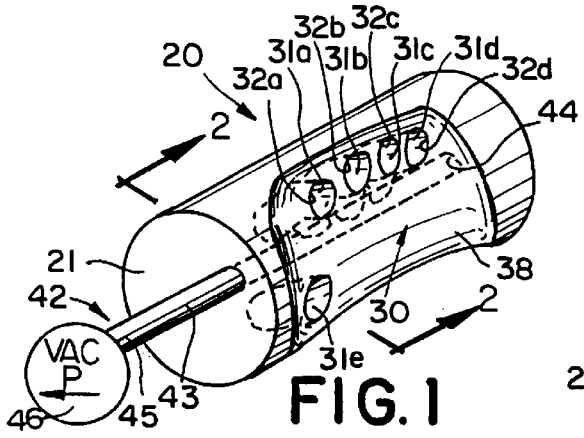
FIG. 1 is a perspective view of a first embodiment of a passive movement device for exercising a hand in accordance with the present invention.
Figure 2:
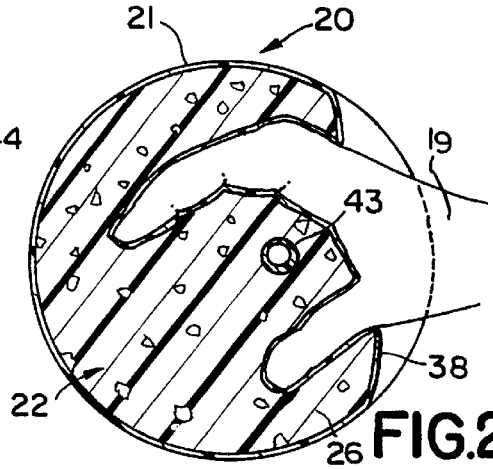
FIG. 2 is a cross-sectional view of the device shown in FIG. 1 taken along line 2—2 of FIG. 1 but showing a hand inserted into the device.

Referring now to FIGS. 1 and 2, a passive movement device 20 for exercising a hand is depicted. The device 20 is particularly suited to exercise the fingers and thumb of a right hand.

The device 20 comprises a generally cylindrical, open-cell foam section 26. The foam section is compressible from its normal configuration and is sufficiently resilient to expand back to its normal position after being compressed. The patient's right hand 19 is held in position on the foam section 26 of the device 20 by a hand rest, generally designated 30, formed directly onto an interior surface of the foam section 26. The hand rest 30 includes a hand depression 38 and finger holes 31*a–e* which extend into the interior of the foam section 26 from the outer surface of foam section 26 at the hand depression 38. Each of the finger holes 31*a–e* is sized and positioned to accommodate a single finger or thumb in its neutral position. External openings 32*a–d* at the mouth of the four finger holes 31*a–d* are aligned substantially collinear along the longitudinal direction of the foam section 26. Further, the finger holes 31*a–d* extend generally parallel to one another along a slightly accurate path into the interior of the foam section 26 so that the patient's fingers can rest while in the neutral position comfortably within the finger holes 31*a–d*. As a result, the finger holes 31*a–d* comfortably receive and accommodate the index, middle, ring, and small fingers, respectively, on the user's right hand 19 in friction or snug fit. A thumb hole 31*e* is in an offset position relative to finger holes 31*a–d* in order to accommodate the thumb of the user's right hand 19 in friction or snug fit. The hand depression 38 in the outer circumference of the foam section is shaped to fit the palm of the user's hand when the thumb and fingers are inserted into the appropriate thumb and finger holes 31*a–e* in a relaxed, gripped position.

A flexible, fluid impermeable cover or casing 21 is provided over the entire exterior surface of foam section 26 to effectively enclose and seal the foam section 26 to form a sealed chamber 22. Accordingly, the outer casing 21 lines finger holes 31*a–e* so that the user's fingers can be positioned within the holes 31*a–e* without disturbing the integrity of the seal created by casing 21. The cover or casing 21 must be sufficiently flexible to enable the cover 21 to contract and stretch during the collapse and expansion of the foam section 26 during the application and non-application of suction from a vacuum source 42. The cover 26 must also be sufficiently gas impermeable to maintain the sealed chamber 22.

The vacuum source, generally designated 42, is provided in the form of a vacuum pump 46 and a fluid transmission tube 43, having a proximal end 44 and a distal end 45, to enable the pressure within sealed chamber 22 to be reduced below atmospheric pressure. The proximal end 44 of tube 43 extends through the casing 21 into the foam section 26. The proximal end 44 of the tube 43 may be embedded along the central axis of the cyclical foam section 26. The tube 43 passes through the casing 21 in such a manner as to maintain the integrity of the sealed chamber 22. Accordingly, the tube 43 must be sealed against the casing 21 at the opening where tube 43 extends through casing 21. The distal end 45 of tube 43 is connected to the vacuum pump 46 so that the suction port of the vacuum pump 46 operatively communicates with the sealed chamber 22. The portion of the proximal end 44 of the tube 43 embedded in the foam section 26 may include a plurality of openings distributed along its length to facilitate contraction of the foam section 26.

Figure 3:
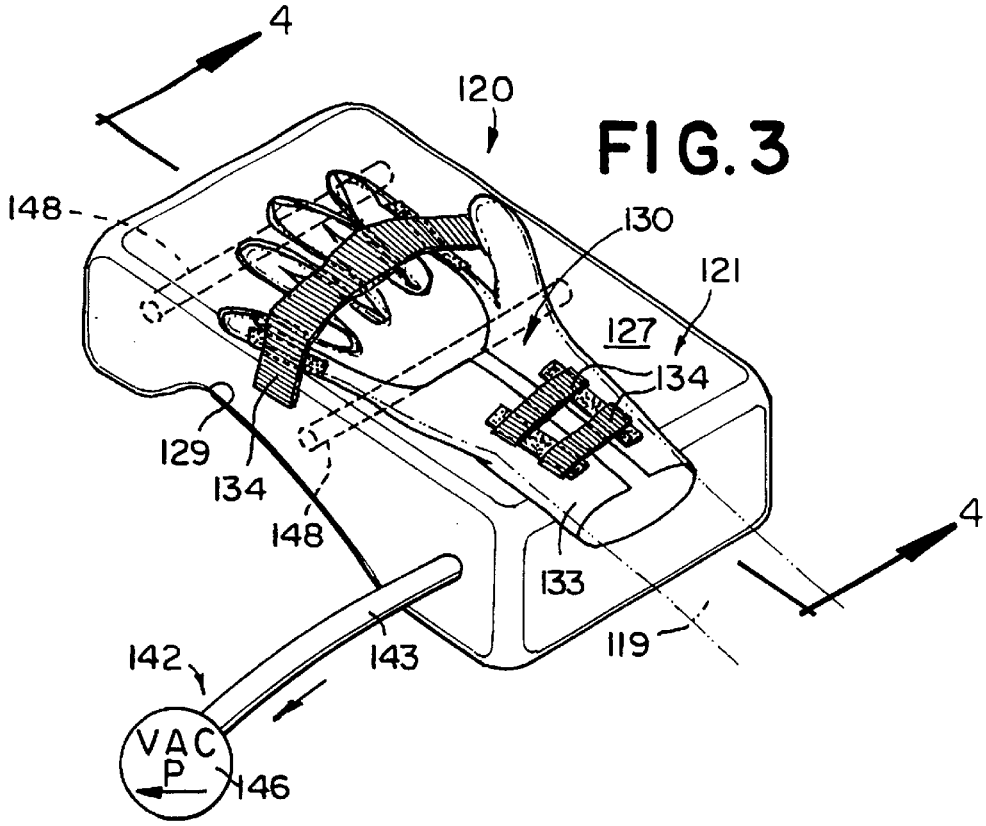
FIG. 3 is a perspective view of a second embodiment of a passive movement device for exercising a hand in accordance with the present invention with a hand shown in phantom inserted into the device.
Figure 4:
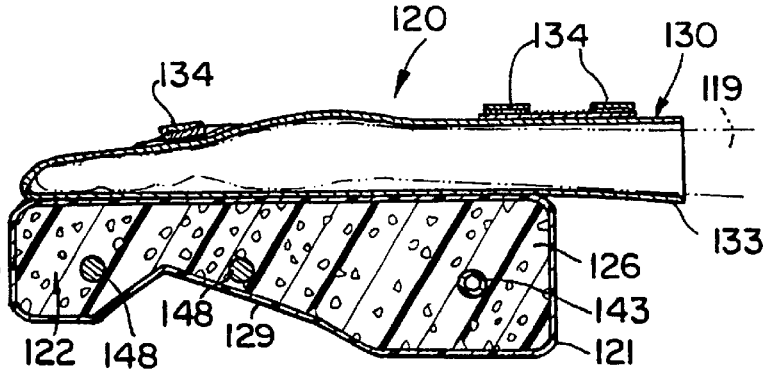
FIG. 4 is a cross-sectional view of the device shown in FIG. 3 taken along line 4—4 of FIG. 3.
Figure 5:
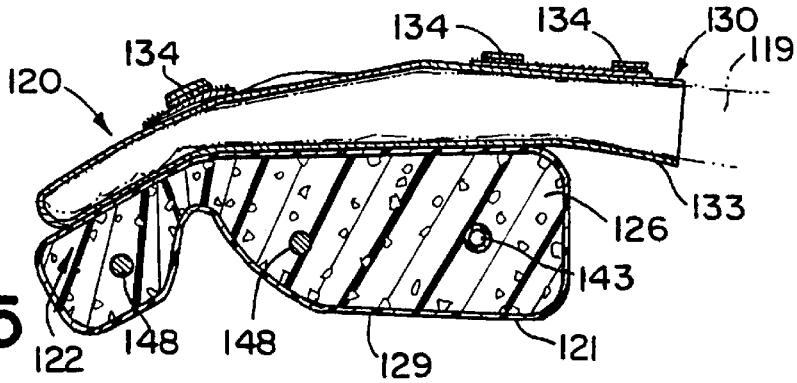
FIG. 5 is a cross-sectional view of the device shown in FIG. 4 but with the fingers of the hand in a flexed position.

A second embodiment of a device 120 of the present invention for precisely exercising the hand is shown in FIGS. 3–5. A foam section 126 is provided which is generally a rectangular solid in shape. The top surface 127 of the foam section 126 is essentially flat, but the bottom surface 129 is contoured in a concave or indented manner. As a result, the area of cross-sectional slices taken perpendicular to the longitudinal axis of the foam section 126 varies along the length of foam section 126. The greater the area of a cross-sectional slice along the length of the foam section 126, the stiffer the foam section 126 becomes at that position. In other words, as the thickness of the foam section 126 decreases at the contoured portions, the foam section 126 becomes less stiff. As shown in FIGS. 3–5, the contoured position of the foam section 126 is positioned to generally underlie the joints of the fingers. Additionally, the foam thickness underlying the finger tips is less than the foam thickness underlying the palm of the hand. Contouring the foam section 126 facilitates the bending of the finger tips upon contraction of the foam section 126. By adjusting the location and amount of foam thickness, the device 120 can be designed to provide biasing and restoring forces of varying strengths to different areas surrounding the joint being exercised. As shown in FIG. 4, for example, the portion of the foam section 126 that underlies a finger joint may have the minimum thickness to facilitate bending of the joint when the vacuum is applied to the sealed chamber 122.

The entire foam section 126 is encased in a flexible, sealed cover or casing 121 to provide a sealed-chamber 122 within which the foam section 126 is contained. The cover 121 must be sufficiently flexible and generally gas impermeable in order to maintain the sealed chamber 122 during expansion and contraction of the inner foam section 126.

A hand retainer, generally designated 130, is provided for maintaining a user's hand 119 in proper alignment with the device 120. For this purpose, a glove 133 is affixed to the outer surface of the casing 121 along the top surface 127 of the foam section 126. Back sections of glove 133 may be removed or slit open to facilitate positioning of the user's hand 119 within the glove 133. Further, straps 134 are attached to the glove 133 to insure that the user's hand is maintained within glove 133. As shown in FIGS. 3–5, the straps 134 comprise hook and loop sections which enable the straps to be securely tightened to maintain the patient's hand in position during treatment.

A vacuum source 142 is also provided. The vacuum source 142 is essentially identical to the source 42 described above in connection with the first embodiment shown in FIGS. 1 and 2. Accordingly, a vacuum pump 146 is connected with the sealed chamber 122 by fluid transmission tube 143.

The device 120 shown in FIGS. 3–5 also includes two struts 148 in the form of elongated, tubular rods or disks made from a rigid or semi-rigid material, such as wood or plastic, which are embedded in the foam section 126 generally transverse to the bending direction of the finger joints. The struts 148 generally span the width of the foam section 126. The struts 148 function to minimize contraction of the foam section 126 in a direction transverse to the bending direction of the joint when the foam section 126 is collapsed by application of a reduced pressure to the sealed chamber 122. The struts 148 may be positioned at desired locations within the foam section 126. For example, the struts 148 may be disposed within the foam section 126 so as to be placed in position directly beneath the joints being treated or on opposite sides of the joint being treated. As shown in FIGS. 3–5, the struts 148 are disposed on opposite sides of the joint and on opposite sides of the indented contour in the bottom surface 129 of the foam section 126 to better enable the foam section 126 to bend at the portion of the contour underlying the joint. Controlling the location at which the foam bends during the application of reduced pressure enables the device 120 to more efficiently function to properly bend the joint.

Figure 6:
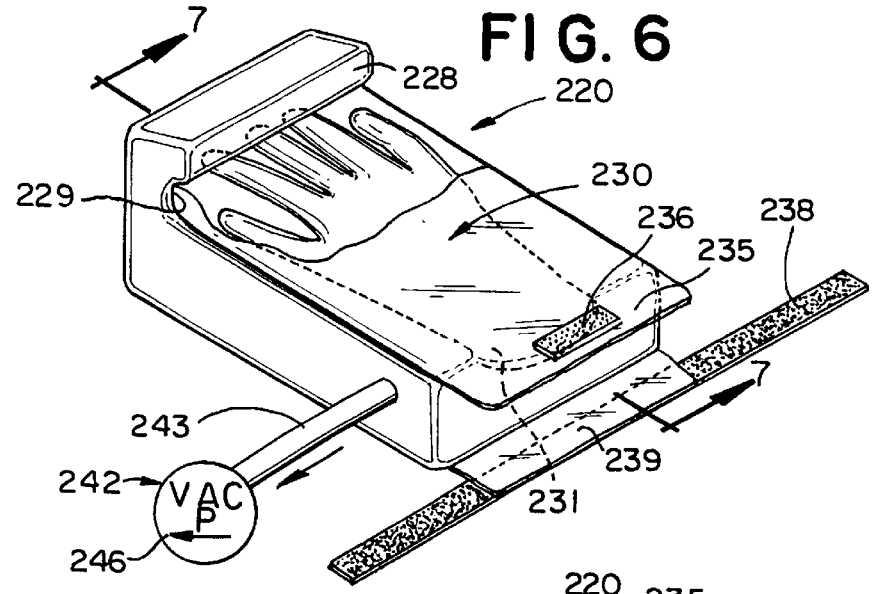
FIG. 6 is a perspective view of a third embodiment of a passive movement device for exercising a hand in accordance with the present invention.
Figure 7:
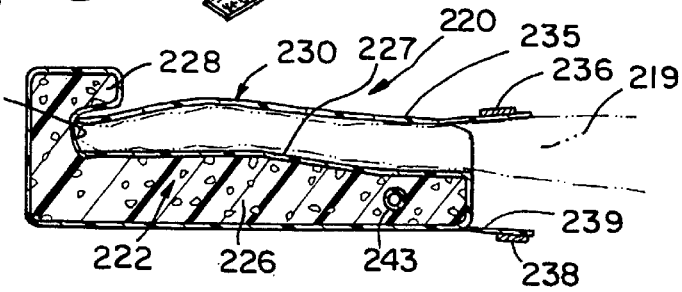
FIG. 7 is a cross-sectional view of the device shown in FIG. 6 taken along line 7—7 of FIG. 6 but with a hand inserted in the device.

A third embodiment of a device 220 for exercising a hand 219 in accordance with the present invention is depicted in FIGS. 6 and 7. The device 220 is similar to device 120. However, the hand retainer 230 of device 220 is provided by a hand-shaped depression or recess 231 formed in the top surface 227 of the foam section 226 of the device 220. Depression 231 is shaped to generally conform to the shape of a hand 219 so that the user's hand 219 can rest comfortably within the depression 231. A covering flap 235 is provided to overlie the user's hand 219 when the hand 219 is positioned within the depression 231. A finger-tip retention lip 228 extends from the top surface 227 of the foam section 226 over the tips of the user's fingers to help maintain the user's hand 219 in position within device 220. The lip 228 forms a finger tip slot 229 for enclosing the finger tips of the user. A hook and loop closure patch 236 is provided on the end of the covering flap 235. A hook and loop closure strap 238 is provided on a cooperating bottom flap 239 for releasably engaging closure patch 236 to secure the device on a patient's hand 219 during treatment. The device 220 is connected to a vacuum pump 246 by tube 243 to provide a vacuum source 242.

Figure 8:
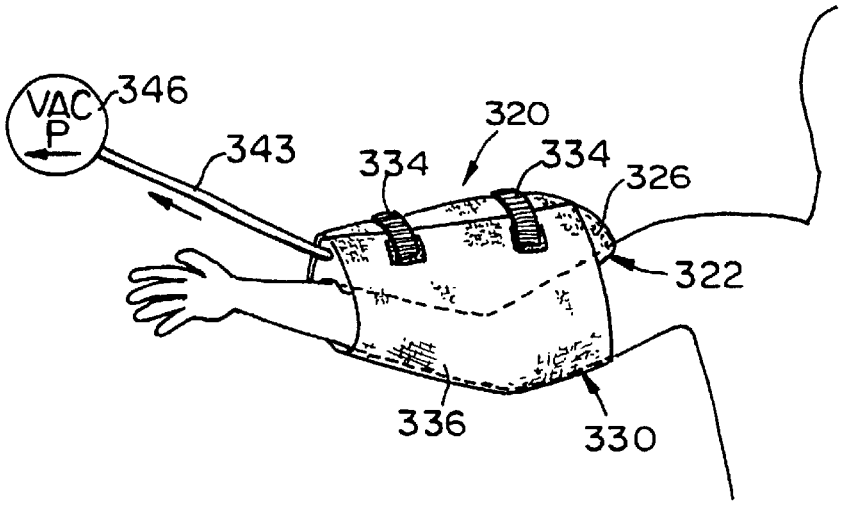
FIG. 8 is a perspective view of a fourth embodiment of a passive movement device for exercising an elbow in accordance with the present invention.
Figure 9:
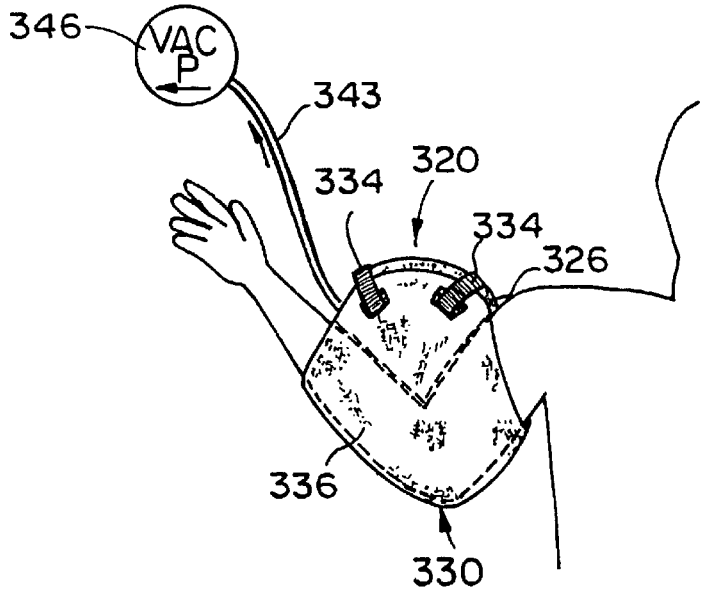
FIG. 9 is a side elevational view of the device shown in FIG. 8 but having the elbow in a flexed position.

A fourth embodiment of a device 320 in accordance with the present invention is depicted in FIGS. 8 and 9. The device 320 is designed to be used to exercise an elbow or a knee. Accordingly, device 320 comprises a sealed foam section 326 which is shaped to fit along the flexion or inner side of the joint to be treated. The joint retainer, generally designated 330, of the device 320 is provided by a flexible sleeve 336 which functions to generally secure the sealed foam section 326 in position at the patient's joint. The sleeve 336 may either be a tubular sleeve or a flat section of material which can be wrapped around the joint and secured in position by closure straps 334. For this purpose, hook and loop closure straps 334 are provided on the sleeve to releasably secure the foam section 326 in proper alignment at the joint. Preferably, the sleeve 336 is manufactured from a material, such as an elastic fabric, which can stretch to fit snugly around the joint when the foam section is in its expanded or uncollapsed configuration, but is sufficiently resilient to stay in position during contraction of the enclosed foam section 326 when suction is applied by the vacuum pump 346 through tube 343. When suction is applied, the foam section 326 contracts causing the elbow to bend as shown in FIG. 9. When the suction is removed, the foam section 326 expands causing the elbow to extend to a neutral position as shown in FIG. 8.

Figure 10:
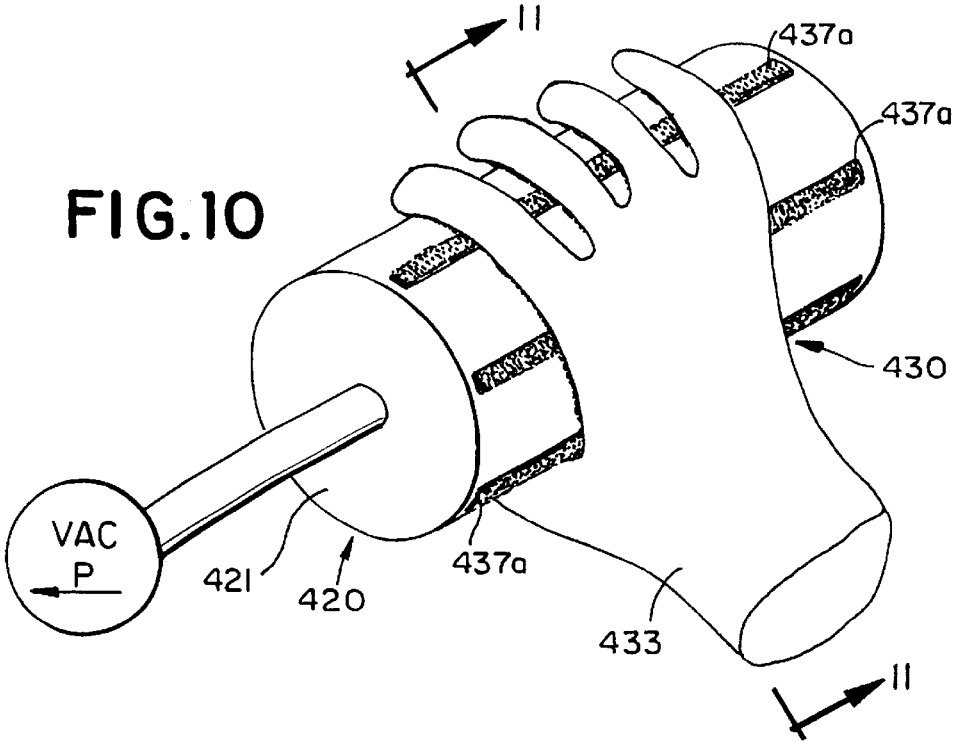
FIG. 10 is a perspective view of a fifth embodiment of a passive movement device for exercising a hand in accordance with the present invention.
Figure 11:
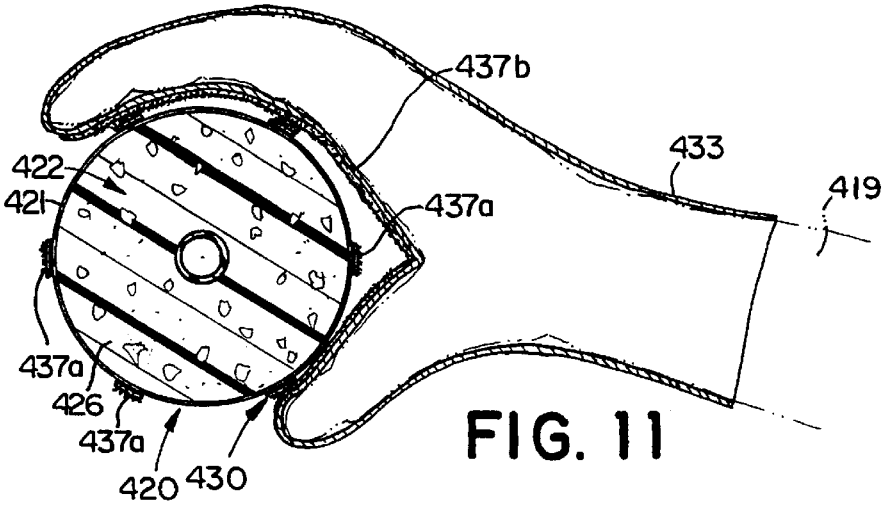
FIG. 11 is a cross-sectional view of the device shown in FIG. 10 taken along line 11—11 of FIG. 10 but with a hand shown in phantom inserted in the device.

A fifth embodiment of a device 420 for exercising a hand 419 in accordance with the present invention is shown in FIGS. 10 and 11. Similar to the embodiment shown in FIGS. 1 and 2, the device 420 comprises a cylindrical foam section 426. However, the diameter of the foam section 426 is selected so that the user can grasp the foam section 426 in his or her hand 419. A sealing casing or cover 421 is provided to enclose foam section 426 within a sealed chamber 422.

A hand retainer, generally designated 430, is provided for holding the user's hand 419 in position. The hand retainer 430 includes a plurality of adhesive strips 437 attached to the outer surface of the cover 421. In the embodiment depicted in FIGS. 10 and 11, the adhesive strips are in the form of hoop and loop closure strips **437*a* which extend as parallel longitudinal stripes along the exterior of the outer cylindrical foam section 426. The closure straps 437*a* are positioned parallel to the central axis of the foam section 426 at spaced apart locations around the circumference of the foam section 426. Mating hook and loop closures 437*b* are attached along the inner portions of the fingers and palm sections of a glove 433. Accordingly, when the user inserts his or her hand 419 into glove 433 and grasps foam section 426, the hook and loop closures 437*b* on the grasping surface of the glove are brought into contact with the closure strips 437*a* on the foam section 426 to releasably hold the gloved hand of the user in contact with the sealed foam section 426**.

Figure 15:
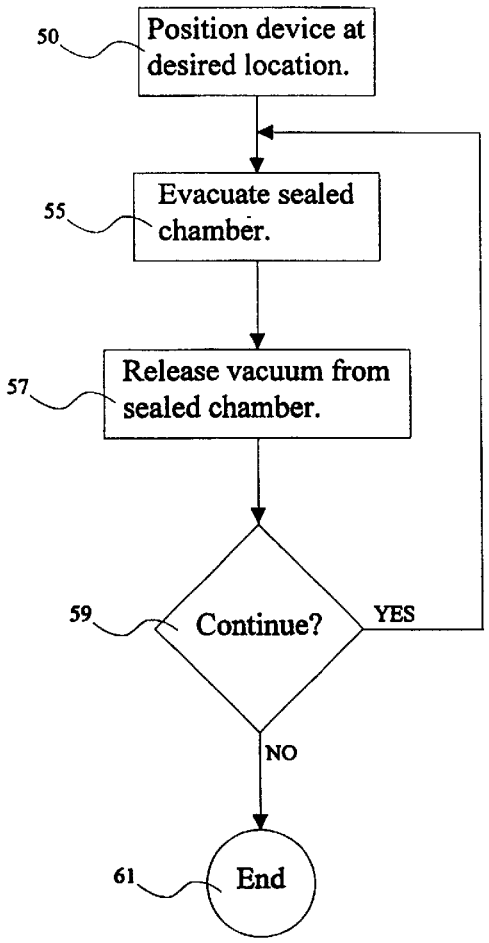
FIG. 15 is a flow chart showing a first embodiment of a method for treating a joint in accordance with the present invention.

In operation, the devices 20, 120, 220, 320, and 420 are used in essentially the same manner. The method of passively exercising a joint using devices 20, 120, 220, 320, and 420 is shown in FIG. 15. First, the particular device 20, 120, 220, 320, or 420 is positioned at step 50 at the desired location relative to the joint to be exercised.

Once the device 20, 120, 220, 320, or 420 is properly positioned relative to the joint, the sealed chamber 22, 122, 222, 322, or 422 is evacuated at step 55 to provide a reduced pressure within the sealed chamber 22, 122, 222, 322, or 422 of less than atmospheric pressure. The reduced pressure collapses the pores in the foam section 26, 126, 226, 326, or 426 thereby contracting the respective foam section and exerting a force on the joint which causes the joint to bend.

After the joint has been bent, the vacuum is released from the sealed chamber 22, 122, 222, 322, or 422 at step 57. As the pressure within the sealed chamber 22, 122, 222, 322, or 422 is restored to atmospheric pressure, the pores in the foam section 26, 126, 226, 326, or 426 inflate thereby expanding the foam section and exerting a force on the joint which causes the joint to return to its starting or neutral position.

At step 59, it is determined whether exercising of the joint is to continue. If the joint is to be further exercised, the method returns to step 55. However, if the joint is not to be further exercised, the method ends at step 61.

Figure 12:
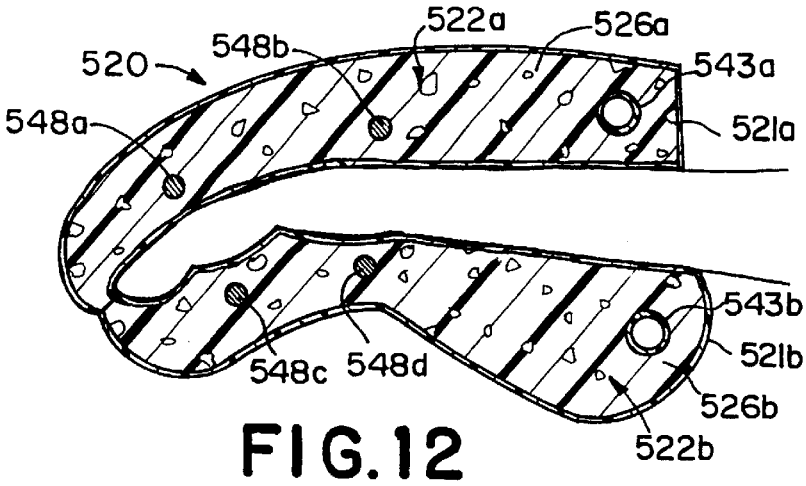
FIG. 12 is a cross-sectional view of a sixth embodiment of the present invention, wherein separate sealed chambers are provided on both sides of the finger joints of a hand in the joint neutral position.
Figure 13:
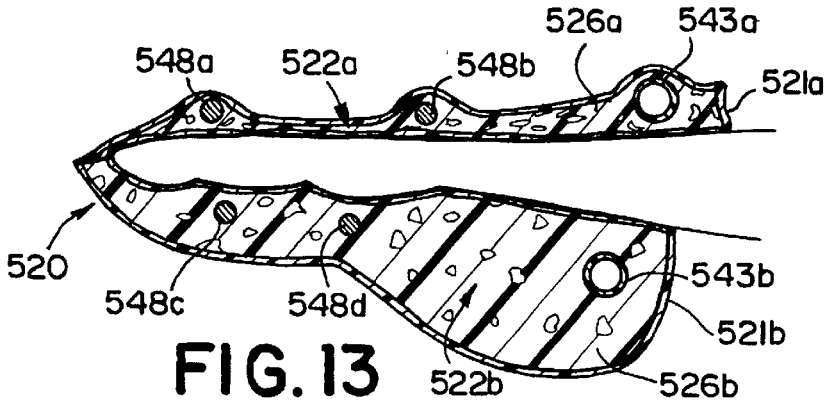
FIG. 13 is a cross-sectional view of the device shown in FIG. 12 but with the finger joint in the joint extension position.
Figure 14:
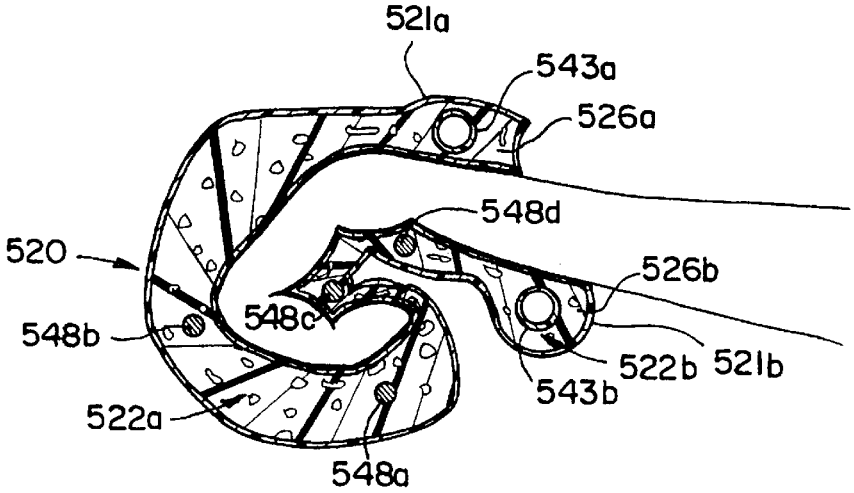
FIG. 14 is a cross-sectional view of the device shown in FIG. 12 but with the finger joints of the hand shown in the joint flexion position.

A sixth embodiment of a device 520 for exercising the hand in accordance with the present invention is depicted in FIGS. 12–14. The device 520 comprises two foam sections 526*a* and 526*b*. The foam sections 526*a* and 526*b* are respectively sealed by covers 521*a* and 521*b*, thereby forming two sealed chambers 522*a* and 522*b*.

Each sealed chamber 522*a* and 522*b* is connected to a vacuum pump or pumps via tubes 543*a* and 543*b*. Accordingly, a reduced pressure can be separately supplied, maintained, or removed relative to each of the sealed chambers 522*a* and 522*b*.

Struts 548*a–d* are provided in the foam sections 526*a* and 526*b*. More specifically, struts 548*a* and 548*b* are embedded within the first foam section 526*a* while struts 548*c* and 548*d* are embedded within the second foam section 526*b*. The struts 548*a–d* generally span the width of the respective foam sections and are positioned generally transverse to the direction of bending to restrict foam contraction and therefore movement of the joint in a direction transverse to the direction of bending.

Figure 16:
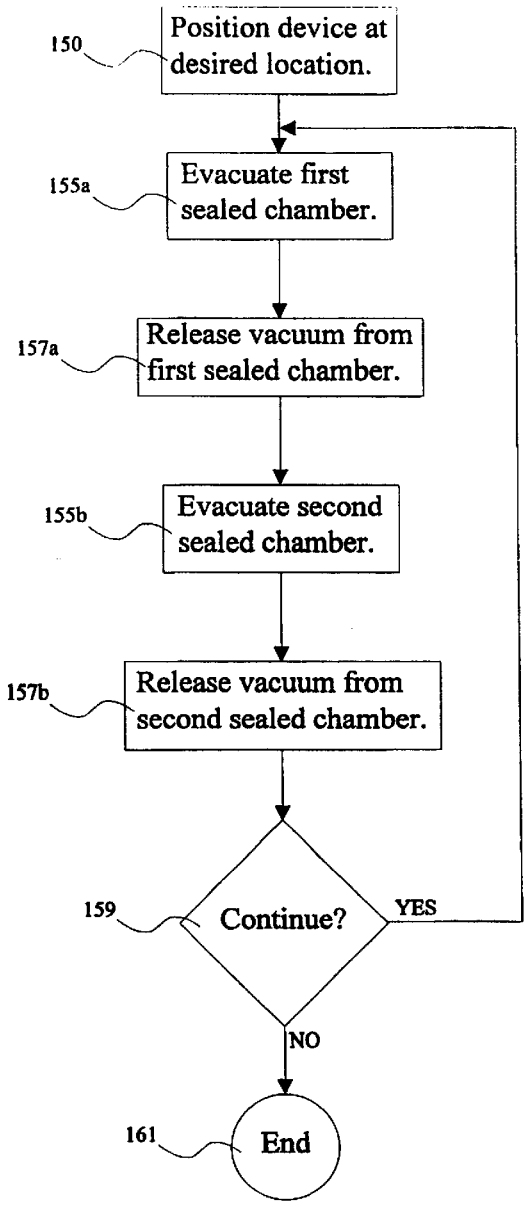
FIG. 16 is a flow chart showing a second embodiment of a method for treating a joint in accordance with the present invention.

In operation, the method of passively exercising a joint using the device 520 is shown in FIG. 16. The joint to be exercised is positioned within device 520, at step 150, with the first foam section 526*a* of the first sealed chamber 522*a* disposed on the extension or outer side of the joint and the second foam section 526*b* of the second sealed chamber 522*b* disposed on the flexion or inner side of the joint. At this point, the joint is preferably maintained in its neutral position as shown in FIG. 12.

Once the device 520 is positioned relative to the joint, suction is applied to the first sealed chamber 522*a* at step 155*a*, thereby reducing the pressure within the first sealed chamber 522*a* to below atmospheric pressure. The reduced pressure collapses the pores of the first foam section 526*a*, thereby causing the first foam section 526*a* to collapse and exert a force on the joint which causes the joint to extend as shown in FIG. 13.

After the joint has been extended, the pressure within the first sealed chamber 522*a* is restored to atmospheric pressure at step 157*a*. As the pressure within the first sealed chamber 522*a* is restored to atmospheric pressure, the pores in the first foam section 526*a* inflate thereby causing the first foam section 526*a* to expand and exert a force on the joint which causes the joint to return to its neutral position as shown in FIG. 12.

Suction is then applied to the second sealed chamber 522*b* at step 155*b*, thereby reducing the pressure within the second sealed chamber 522*b*. The reduced pressure collapses the pores of the second foam section 526*b*, thereby causing the second foam section 526*b* to collapse and exert a force on the joint which causes the joint to flex as shown in FIG. 14.

After the joint has been flexed, the pressure within the second sealed chamber 522*b* is restored to atmospheric pressure at step 157*b*. As the pressure within the second sealed chamber 522*b* is restored to atmospheric pressure, the pores in the second foam section 526*b* inflate thereby causing the second foam section to expand and exert a force on the joint which causes the joint to return to its neutral position as shown in FIG. 12.

The process is continued until the joint has been exercised for an appropriate length of time. At step 159, it is determined whether exercising of the joint is to continue. If the joint is to be further exercised, the method returns to step 155*a*. However, if the joint is not to be exercised any further, the method ends at step 161. Of course, the application of the vacuum can be controlled in time and magnitude relative to the first and second sealed chambers to provide a controlled exercise environment for a patient's joint. For example, the magnitude of the vacuum pressure applied to the first sealed chamber can be different from the magnitude applied to the second sealed chamber. In fact, different magnitudes can be applied to the same sealed chamber in different sequences. Further, vacuums may be released and applied at selected intervals. For example, the application of the vacuum to one chamber may be maintained for a selected interval during the time that the vacuum is also applied to the other chamber. Additionally, the resiliency or stiffness of the foam can be selected to effect a desired passive exercise program of a selected duration for each patient.

EXAMPLES

A passive movement device in accordance with the present invention was used to exercise the right and left hands of a patient. The patient suffered from full thickness burn injuries to both hands and such injuries were treated with split skin grafts. The patient was fitted with a passive movement device similar to the embodiment shown in FIGS. 3–5. The range of motion (in degrees) of the metacarpophalangeal (MCP), proximal interphalangeal (PIP), and distal interphalangeal (DIP) joints on each of the index, long, ring, and small fingers were measured both before treatment and after continuous treatment with the device for 48 hours. The data are shown in Table 1.

TABLE 1

| | Left Hand | | | | | | | Right Hand | | | | | | |
|---|---|---|---|---|---|---|---|---|---|---|---|---|---|---|
| | Before | | | After | | | | Before | | | After | | | |
| Joint | Start | Max | Range | Start | Max | Range | % Change | Start | Max | Range | Start | Max | Range | % Change |
| Index Finger: | | | | | | | | | | | | | | |
| MCP | 35 | 110 | 75 | 35 | 85 | 50 | −33 | 30 | 90 | 60 | 25 | 85 | 60 | 0 |
| PIP | 15 | 95 | 80 | 5 | 55 | 80 | 0 | 5 | 60 | 55 | 0 | 90 | 90 | 64 |
| DIP | 10 | 45 | 35 | 10 | 35 | 25 | −28 | 0 | 40 | 40 | 0 | 50 | 50 | 25 |
| Long Finger: | | | | | | | | | | | | | | |
| MCP | 35 | 90 | 55 | 15 | 85 | 60 | 27 | 30 | 90 | 60 | 25 | 95 | 70 | 17 |
| PIP | 0 | 75 | 75 | 0 | 95 | 95 | 27 | 0 | 60 | 60 | 0 | 70 | 70 | 17 |
| DIP | 0 | 40 | 40 | 5 | 45 | 40 | 0 | 5 | 40 | 35 | 0 | 40 | 40 | 14 |
| Ring Finger: | | | | | | | | | | | | | | |
| MCP | 10 | 75 | 65 | 0 | 75 | 75 | 15 | 20 | 75 | 55 | 15 | 100 | 85 | 54 |
| PIP | 5 | 75 | 70 | 30 | 90 | 60 | −14 | 0 | 90 | 90 | 0 | 75 | 75 | −17 |
| DIP | 0 | 30 | 30 | 5 | 45 | 40 | 33 | 5 | 25 | 20 | 0 | 45 | 45 | 125 |
| Small Finger: | | | | | | | | | | | | | | |
| MCP | 30 | 70 | 40 | 5 | 60 | 55 | 38 | 15 | 90 | 75 | 15 | 90 | 75 | 0 |
| PIP | — | — | — | — | — | — | — | 5 | 45 | 40 | 0 | 75 | 75 | 88 |
| DIP | — | — | — | — | — | — | — | 0 | 50 | 50 | 0 | 40 | 40 | −20 |

From the data in Table 1, an average change in the range of motion (% Change) is determined to be about 20%. The "% Change" is defined as the range after treatment minus the range before treatment, divided by the range before treatment multiplied by 100%. Accordingly, treatment with the passive movement device substantially improved the range of motion of the affected joints.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A passive movement device for exercising a patient's joint, the joint having a flexion side and an extension side, said device comprising:

a. a bendable foam section;

b. joint positioning means for holding a joint at a desired position relative to the device; and c. a casing enclosing the foam section to provide a sealed chamber about the foam section, the casing adapted to be operatively connected to a pump for selectively providing application of a reduced pressure to the sealed chamber to contract and bend the foam section to move the joint from a predetermined position toward a selected position and for selectively removing the reduced pressure from the sealed chamber to enable the foam to expand and move the joint back toward the predetermined position.

2. The device recited in claim 1 wherein the foam section comprises an open-cell foam section.

3. The device recited in claim 1 wherein the foam section comprises a sponge.

4. The device recited in claim 1 wherein the foam section is shaped to fit along the flexion side of the joint.

5. The device recited in claim 1 wherein the foam section is shaped to fit along the extension side of the joint.

6. The device recited in claim 1 wherein the casing comprises a laminate around the foam section to form the sealed chamber.

7. The device recited in claim 1 wherein the casing comprises a coating applied to the foam section to form the sealed chamber.

8. The device recited in claim 1 wherein the joint positioning means comprises a finger groove within the foam section to permit insertion of a finger therein to hold other fingers in position relative to the sealed chamber.

9. The device recited in claim 1 wherein the positioning means comprises a glove to hold a hand in position relative to the sealed chamber.

10. The device recited in claim 1 wherein the positioning means comprises a sleeve to permit insertion of the joint therein to hold the joint in position relative to the sealed chamber.

11. A passive movement device for exercising a patient's joint, the joint having a flexion side and an extension side, comprising:

a. a first foam section shaped to fit about the extension side of the joint;

b. a second foam section shaped to fit about the flexion side of the joint;

c. a first casing enclosing the first foam section to provide a first sealed chamber about the first foam section;

d. a second casing enclosing the second foam section to provide a second sealed chamber about the second foam section; and e. joint positioning means for positioning the joint relative to the first and second sealed chambers, the first and second sealed chambers adapted to be operatively connected to a pump for separately providing an application and non-application of a reduced pressure to the first and second sealed chambers to selectively contract and expand the first and second foam sections to controllably move the joint.

12. The device recited in claim 11 wherein the first and second foam sections comprise an open-cell foam section.

13. The device recited in claim 11 wherein the first and second foam sections comprise a sponge.

14. The device recited in claim 11 wherein the first casing comprises a laminate around the first foam section to form the first sealed chamber.

15. The device recited in claim 11 wherein the second casing comprises a laminate around the second foam section to form the second sealed chamber.

16. The device recited in claim 11 wherein the first casing comprises a coating applied to the first foam section to form the first sealed chamber.

17. The device recited in claim 11 wherein the second casing comprises a coating applied to the second foam section to form the second sealed chamber.

18. The device recited in claim 11 wherein the positioning means comprises a glove to hold a hand in position relative to the first and second sealed chambers.

19. The device recited in claim 11 wherein the positioning means comprises a sleeve to hold a hand in position relative to the first and second sealed chambers.

20. A method for passively exercising a patient's joint, the joint having a flexion side and an extension side, comprising the steps of:

a. positioning the joint relative to a foam section enclosed within a sealed chamber;

b. applying a reduced pressure to the sealed chamber, causing the foam section to collapse and the joint to move from a predetermined position; and c. restoring the pressure within the sealed chamber to atmospheric pressure, causing the foam section to expand and the joint to move toward the predetermined position.

21. A method for passively exercising a patient's joint, the joint having a flexion side and an extension side, comprising the steps of:

a. positioning a first foam section within a first sealed chamber on the extension side of the joint;

b. positioning a second foam section within a second sealed chamber at the flexion side of the joint;

c. applying a reduced pressure to the first sealed chamber to evacuate the first sealed chamber below atmospheric pressure causing the first foam section to collapse and the joint to move from a first position;

d. restoring pressure within the first sealed chamber toward atmospheric pressure to inflate the first sealed chamber causing the first foam section to expand and the joint to move toward the first position;

e. applying a reduced pressure to the second sealed chamber to evacuate the second chamber below atmospheric pressure, causing the second foam section to collapse and the joint to move from a second position; and f. restoring the pressure within the second sealed chamber toward atmospheric pressure to inflate the second sealed chamber causing the second foam section to expand and the joint to move toward the second position.

22. A passive movement device for exercising a patient's joint, the joint having a flexion side and an extension side, said device comprising:

a. a bendable foam section including a plurality of sections having different degrees of stiffness for positioning at different locations relative to a joint to control movement of the joint;

b. joint positioning means for holding a joint at a desired position relative to the device; and c. a casing enclosing the foam section to provide a sealed chamber about the foam section, the casing adapted to be operatively connected to a pump for selectively providing application of a reduced pressure to the sealed chamber to contract and bend the foam section to move the joint from a predetermined position toward a selected position and for selectively removing the reduced pressure from the sealed chamber to enable the foam to expand and move the joint back toward the predetermined position.

23. A passive movement device for exercising a patient's joint, the joint having a flexion side and an extension side, said device comprising:

a. a foam section;

b. at least one strut embedded within the foam section at a selected location relative to a joint to prevent contraction of the foam section in a transverse direction relative to the joint;

c. joint positioning means for securing the joint at a desired position relative to the foam section; and d. a casing enclosing the foam section to provide a sealed chamber about the foam section, the casing adapted to be operatively connected to a pump for selectively providing application of a reduced pressure to the sealed chamber to contract the foam section to move the joint from a predetermined position toward a selected position and for selectively removing the reduced pressure from the sealed chamber to enable the foam to expand and move the joint back toward the predetermined position.

24. A passive movement device for exercising a patient's joint, the joint having a flexion side and an extension side, comprising:

a. a first foam section shaped to fit about the extension side of a joint, the first foam section including a plurality of sections having different degrees of stiffness for positioning at different locations relative to the joint to control movement of the joint;

b. a second foam section shaped to fit about the flexion side of the joint;

c. a first casing enclosing the first foam section to provide a first sealed chamber about the first foam section;

d. a second casing enclosing the second foam section to provide a second sealed chamber about the second foam section; and e. joint positioning means for securing the joint at a desired position relative to the first and second sealed chambers, the first and second sealed chambers adapted to be operatively connected to a pump for separately providing an application and non-application of a reduced pressure to the first and second sealed chambers to selectively contract and expand the first and second foam sections to controllably move the joint.

25. A passive movement device for exercising a patient's joint, the joint having a flexion side and an extension side, comprising:

a. a first foam section shaped to fit about an extension side of a joint;

b. a second foam section shaped to fit about a flexion side of the joint, the second foam section including a plurality of sections having different degrees of stiffness for positioning at different locations relative to the joint to control movement of the joint;

c. a first casing enclosing the first foam section to provide a first sealed chamber about the first foam section;

d. a second casing enclosing the second foam section to provide a second sealed chamber about the second foam section; and e. joint positioning means for securing the joint at a desired position relative to the first and second sealed chambers, the first and second sealed chambers adapted to be operatively connected to a pump for separately providing an application and non-application of a reduced pressure to the first and second sealed chambers to selectively contract and expand the first and second foam sections to controllably move the joint.

26. A passive movement device for exercising a patient's joint, the joint having a flexion side and an extension side, comprising:

a. a first foam section shaped to fit about an extension side of a joint;

b. at least one strut embedded within the first foam section at a selected location relative to the joint to prevent contraction of the first foam section in a transverse direction relative to the joint c. a second foam section shaped to fit about a flexion side of the joint;

d. a first casing enclosing the first foam section to provide a first sealed chamber about the first foam section;

e. a second casing enclosing the second foam section to provide a second sealed chamber about the second foam section; and f. joint positioning means for securing the joint at a desired position relative to the first and second sealed chambers, the first and second sealed chambers adapted to be operatively connected to a pump for separately providing an application and non-application of a reduced pressure to the first and second sealed chambers to selectively contract and expand the first and second foam sections to controllably move the joint.

27. A passive movement device for exercising a patient's joint, the joint having a flexion side and an extension side, comprising:

a. a first foam section shaped to fit about an extension side of a joint;

b. a second foam section shaped to fit about a flexion side of the joint;

c. at least one strut embedded within the second foam section at a selected location relative to the joint to prevent contraction of the second foam section in a transverse direction relative to the joint;

d. a first casing enclosing the first foam section to provide a first sealed chamber about the first foam section;

e. a second casing enclosing the second foam section to provide a second sealed chamber about the second foam section; and f. joint positioning means for securing the joint at a desired position relative to the first and second sealed chambers, the first and second sealed chambers adapted to be operatively connected to a pump for separately providing an application and non-application of a reduced pressure to the first and second sealed chambers to selectively contract and expand the first and second foam sections to controllably move the joint.

* * * * *